US006474702B1

(12) United States Patent
Malone et al.

(10) Patent No.: US 6,474,702 B1
(45) Date of Patent: Nov. 5, 2002

(54) RANGE DOOR LOCK WITH NUISANCE LATCH

(75) Inventors: Charles Malone, Smithville, TN (US); James D. Livers, Jr., Cookeville, TN (US); James Ramsey, Murfreesboro, TN (US)

(73) Assignee: France/Scott Fetzer Company, Fairview, TN (US)

( * ) Notice: Subject to any disclaimer, the term of this patent is extended or adjusted under 35 U.S.C. 154(b) by 0 days.

(21) Appl. No.: 09/639,588

(22) Filed: Aug. 16, 2000

(51) Int. Cl.[7] ..... E05C 19/10

(52) U.S. Cl. ..... 292/97; 292/DIG. 66; 292/DIG. 69; 70/DIG. 10

(58) Field of Search ..... 292/DIG. 66, DIG. 69, 292/97, 123, 196; 70/DIG. 10; 126/42, 191

(56) References Cited

U.S. PATENT DOCUMENTS

| | | | | | |
|---|---|---|---|---|---|
| 3,094,605 | A | | 6/1963 | Welch | 219/20 |
| 3,099,471 | A | | 7/1963 | Scott et al. | 292/7 |
| 3,116,398 | A | | 12/1963 | Welch | 219/20 |
| 3,125,365 | A | | 3/1964 | Eigelbach | 292/7 |
| 3,133,168 | A | | 5/1964 | Jacobson | 200/61.68 |
| 3,176,485 | A | | 4/1965 | Chisholm | 70/121 |
| 3,189,375 | A | | 6/1965 | Getman | 292/113 |
| 3,214,567 | A | | 10/1965 | Chisholm | 219/413 |
| 3,313,918 | A | | 4/1967 | Barber | 219/412 |
| 3,317,708 | A | | 5/1967 | Bowling | 219/412 |
| 3,350,542 | A | | 10/1967 | Getman | 219/412 |
| 3,362,398 | A | * | 1/1968 | Fane, Jr. | 126/273 |
| 3,367,697 | A | * | 2/1968 | Fox, Sr. | 292/113 |
| 3,387,874 | A | * | 6/1968 | Holtkamp | 292/201 |
| 3,390,909 | A | * | 7/1968 | Nagel | 292/201 |
| 3,406,677 | A | * | 10/1968 | Anderson | 126/197 |
| 3,409,320 | A | * | 11/1968 | Eckerle | 292/113 |
| 3,410,591 | A | * | 11/1968 | Fowler | 292/113 |
| 3,438,666 | A | * | 4/1969 | Erickson | 292/210 |
| 3,440,403 | A | * | 4/1969 | Lafforgue | 219/413 |
| 3,462,584 | A | * | 8/1969 | Guy | 219/412 |
| 3,469,568 | A | * | 9/1969 | Torrey et al. | 126/39 |
| 3,476,424 | A | | 11/1969 | Erickson | 292/66 |
| 3,498,295 | A | | 3/1970 | Brickson et al. | 128/272 |
| 3,521,618 | A | | 7/1970 | Smith et al. | 126/197 |
| 3,548,804 | A | | 12/1970 | Faehling | 126/37 |

(List continued on next page.)

*Primary Examiner*—Anthony Knight
*Assistant Examiner*—John B. Walsh
(74) *Attorney, Agent, or Firm*—Wood, Herron & Evans, L.L.P.

(57) ABSTRACT

An oven door lock for self-cleaning ovens is described. The oven door lock includes a manually operated latch mechanism moveable from an unlatched state. In the latched state, a thermally responsive element is provided with a pin adapted to be received in a hole defined in the latch mechanism to lock the latch mechanism in the latched state during self-cleaning operation. The oven door lock is provided with a nuisance latch which prevents the latch mechanism from being moved to the latched state during non-self-cleaning use of the oven. A switch is provided to indicate when the latch mechanism is in the latched state. An insulation pad is sandwiched between the switch and a mounting bracket of the oven door lock to thermally and electrically insulate the switch from the oven door lock.

16 Claims, 5 Drawing Sheets

U.S. PATENT DOCUMENTS 3,569,670 A 3/1971 Eff ..... 219/413
3,610,883 A 10/1971 Holtkamp ..... 219/143
3,625,197 A 12/1971 Pirker et al. ..... 126/273 R
3,638,638 A 2/1972 Phifer ..... 126/197
3,642,313 A 2/1972 Anderson ..... 292/66
3,646,612 A 2/1972 Anderson ..... 292/200
3,648,011 A 3/1972 Holtkamp ..... 219/413
3,707,145 A 12/1972 Anetsberger et al. ..... 126/21 A
3,745,988 A 7/1973 Frick ..... 126/273 R
3,750,643 A 8/1973 Fowler et al. ..... 126/197
3,757,084 A 9/1973 McLean et al. ..... 219/413
3,776,216 A 12/1973 Pirker et al. ..... 126/197
3,815,942 A 6/1974 White ..... 292/113
3,823,294 A 7/1974 Takayama et al. ..... 219/10.55
3,831,580 A 8/1974 McLean ..... 126/197
3,859,979 A 1/1975 Gilliom ..... 126/197
3,875,372 A 4/1975 Gilliom ..... 219/413
3,889,654 A 6/1975 Kauranen et al. ..... 126/194
3,894,214 A 7/1975 Staples ..... 219/394
3,912,904 A 10/1975 Phifer ..... 219/413
3,968,983 A 7/1976 Heit et al. ..... 292/201
3,985,023 A 10/1976 Guth ..... 70/267
4,013,312 A 3/1977 DeWeese ..... 292/113
4,039,993 A * 8/1977 Kerr ..... 337/366
4,082,077 A 4/1978 Marfatia et al. ..... 126/197
4,082,078 A 4/1978 Thuleen et al. ..... 126/197
4,088,354 A 5/1978 Kolendowicz ..... 292/201
4,101,750 A 7/1978 Doner ..... 219/10.55 C
4,105,229 A 8/1978 Kaldenberg ..... 292/113
4,109,637 A 8/1978 Drouin ..... 126/197
4,133,337 A 1/1979 Shea ..... 126/197
4,136,667 A 1/1979 Lewis ..... 126/197
4,163,443 A 8/1979 Peterson ..... 126/197
4,174,860 A 11/1979 Shea ..... 292/113
4,230,350 A 10/1980 Gee et al. ..... 292/144
4,236,501 A 12/1980 Bitler ..... 126/197
4,316,079 A 2/1982 Schmitz ..... 219/413
4,321,445 A 3/1982 Kristof et al. ..... 219/10.55 C
4,340,806 A 7/1982 Bergquist ..... 219/413
4,345,144 A 8/1982 Bergquist ..... 219/413
4,351,288 A 9/1982 Gasloli ..... 126/197
4,364,589 A 12/1982 Watson ..... 292/113
4,374,320 A 2/1983 Barnett ..... 219/413
4,457,545 A 7/1984 Wilson et al. ..... 292/29
4,554,907 A 11/1985 Overley et al. ..... 126/191
4,593,945 A 6/1986 Arute et al. ..... 292/201
4,623,179 A 11/1986 Davis et al. ..... 292/201
4,825,027 A 4/1989 Yoon ..... 219/10.55 C
4,838,586 A 6/1989 Henne ..... 292/113
4,858,969 A 8/1989 Lee ..... 292/78
4,861,078 A 8/1989 Munoz ..... 292/113
4,862,870 A 9/1989 Fox ..... 126/197
4,917,414 A 4/1990 Boulanger ..... 292/98
4,927,996 A 5/1990 Genbauffe et al. ..... 219/413
4,944,170 A 7/1990 Jolidon et al. ..... 270/267
4,960,297 A 10/1990 Bouse et al. ..... 292/223
4,982,063 A 1/1991 Tsunekawa et al. ..... 219/10.55
4,995,313 A 2/1991 Delau et al. ..... 99/467
4,995,650 A 2/1991 Schantz et al. ..... 292/201
5,004,276 A 4/1991 Hanley ..... 292/126
5,012,794 A 5/1991 Faurel ..... 126/197
5,029,910 A 7/1991 Genbauffe et al. ..... 292/110
5,062,668 A 11/1991 Onderka et al. ..... 292/25
5,072,974 A 12/1991 Henne ..... 292/126
5,121,950 A 6/1992 Davidian ..... 292/164
5,220,153 A 6/1993 Malone et al. ..... 219/412
5,419,305 A 5/1995 Hanley ..... 126/197
5,440,103 A 8/1995 Martin ..... 219/413
5,456,243 A 10/1995 Jones ..... 126/197
5,477,030 A 12/1995 Buckshaw et al. ..... 219/413
5,493,099 A 2/1996 McWilliams, III ..... 219/413
5,676,408 A 10/1997 Davidian ..... 292/197
5,746,005 A 5/1998 Steinberg ..... 33/1 PT
5,746,456 A 5/1998 Violi ..... 292/146
6,302,098 B1 * 10/2001 Smith ..... 126/197
6,315,336 B1 * 11/2001 Swartzell ..... 292/201
6,364,376 B1 * 4/2002 Spargo ..... 292/97
6,402,208 B1 * 6/2002 Shimizu ..... 292/123

* cited by examiner

RANGE DOOR LOCK WITH NUISANCE LATCH

FIELD OF THE INVENTION

The present invention relates to door locks for ranges and ovens. More specifically, the present invention relates to manual range and oven locks for the doors of self-cleaning ovens.

BACKGROUND

Modern ovens are often equipped with the capability to self-clean. Self-cleaning is accomplished by heating the oven to temperatures of approximately 400–480° C. (750–900° F.). Self-cleaning ovens typically employ a door lock to latch and lock the oven door during the cleaning operation. Existing door locks take various forms, the most advanced of which will automatically lock the door at the beginning of the cleaning operation and automatically unlock the door when the oven reaches a predetermined reduced temperature.

In some self-cleaning ovens, a bimetallic coil, which is responsive to the temperature in the oven, moves a pawl into a blocking position with respect to a latch to prevent the latch from moving from a latched position to an unlatched position after the bimetallic coil senses temperatures above a predetermined level. Such devices are disclosed in U.S. Pat. Nos. 3,438,666; 4,133,337 and 4,838,586.

The bimetallic coil is, of course, sensitive to the heat in the oven, whether it is in a self-cleaning mode or in any heating mode, and will move the blocking pawl towards a blocking position in either mode. It is possible to lock the oven door shut inadvertently during an extended bake cycle. If the oven remains in a bake mode at an elevated temperature for an extended period of time, the locking pawl may move to a position which would block the movement of the handle from the latched position to the unlatched position.

A problem is presented by the possibility that, during an extended baking cycle, the latching handle may be inadvertently moved to the latched position. This may be possible because the latch may be cammed past the locking pawl and the latch will be blocked from unlatching until the oven temperature falls to a level such that the bimetallic element will move the locking pawl away from a block position. This can have deleterious effects on the contents of the oven which are being subjected to baking, in that the oven door cannot be opened at the desired time, and the contents of the oven will continue to bake, perhaps resulting in a burned condition or an overcooked condition.

OBJECTIVES OF THE PRESENT INVENTION

Accordingly, it is an object of the present invention to provide an improved oven door lock which prevents inadvertent oven self-cleaning operation.

It is another objective of this invention to provide an improved oven door lock which is more easily assembled with a cooking apparatus.

It is yet another objective of the present invention to provide a latching mechanism for self-cleaning ovens which can withstand high temperatures.

Yet another objective of the present invention is to provide a latching mechanism which senses whether an oven door is latched and locked to allow self-cleaning operation.

A further objective of the present invention is to provide a latching mechanism with a minimal number of parts for greater reliability and simplified assembly.

SUMMARY OF THE INVENTION

The invention preferably embodies an improved oven door lock for use in a self-cleaning oven having a door moveable between open and closed positions and a device for effecting a heat self-cleaning cycle when the door has been closed and latched. The door lock generally includes a mounting bracket to which a latch mechanism with a moveable latch arm is pivotally mounted and a lock mechanism with a thermally responsive element adapted to lock the latch arm in a latched state during oven self-cleaning.

A link arm is provided to link the latch arm with a handle mount to which a handle is affixed to effect manual operation of the door lock. The mounting bracket and link arm define respective holes which align substantially coaxially with each other when the latch mechanism is moved from the unlatched to the latched state. The thermally responsive element is preferably a bimetallic leaf which has a lock member affixed thereto. When the oven is placed in self-cleaning mode, the bimetallic leaf is heated and deflects so that the lock member is received through the axially aligned holes in the mounting bracket and link arm. When the lock member is received through the holes, the latch mechanism is prevented from being moved from the latched state to the unlatched state during self-cleaning operation. The bimetallic leaf does not need to be calibrated to respond to heating of the oven chamber, unlike thermally responsive elements of the prior art.

The lock mechanism, including the bimetallic leaf and the lock member, is a separable subassembly to the oven door lock. That is, the lock mechanism is detachable from the mounting bracket, thereby providing ease of assembly and maintenance to the oven door lock. In addition, the lock mechanism includes a depending hook which is adapted to engage an oven cavity wall during assembly. Prior art oven door locks have been generally very difficult to assemble with the oven cavity wall and the provision of the hook on the lock mechanism eliminates a significant amount of time and labor expended upon assembly of the oven door lock with the oven. Assembly of the latch mechanism to the mounting bracket is provided upon a single surface of the mounting bracket. That is, the latch mechanism including the latch, the link arm, the handle mount, a handle, and a biasing spring is assembled to one surface of the mounting bracket to provide additional ease of assembly.

The oven door lock includes a switch adapted to indicate whether the latch is in either the unlatched or latched state. The switch is attached to the mounting bracket with an insulation pad sandwiched therebetween to electrically and thermally insulate the switch from the mounting bracket. The insulation pad prevents overheating of the switch and prevents the switch from transferring an electric charge to the mounting bracket and, therefore, the oven to prevent a user from receiving an electric shock.

The latch mechanism includes an improved nuisance latch which prevents the latch mechanism from being moved from the unlatched state to the latched state and, therefore, avoiding locking of the latch mechanism in the latched state, during non-self-cleaning operation of the oven. The nuisance latch includes a thermally responsive element which deflects into engagement with the latch mechanism as the oven is used for cooking. When the thermally responsive element engages the latch mechanism, the holes in the mounting bracket and the link arm are prevented from aligning. Thus, when the lock mechanism bimetallic leaf deflects upwardly in response to heating the oven, the lock member is prevented from locking the latch mechanism in the latched state.

Other objects and advantages and a full understanding of the invention will be had from the following detailed description of the preferred embodiments and the accompanying drawings.

BRIEF DESCRIPTION OF THE FIGURES

The accompanying drawings, which are incorporated in and constitute a part of this specification, illustrate embodiments of the invention and, together with a general description of the invention given above, and the detailed description of the embodiments given below, serve to explain the principles of the invention.

Preferred embodiments of the invention are shown in the accompanying drawings in which.

DETAILED DESCRIPTION

Figure 1:
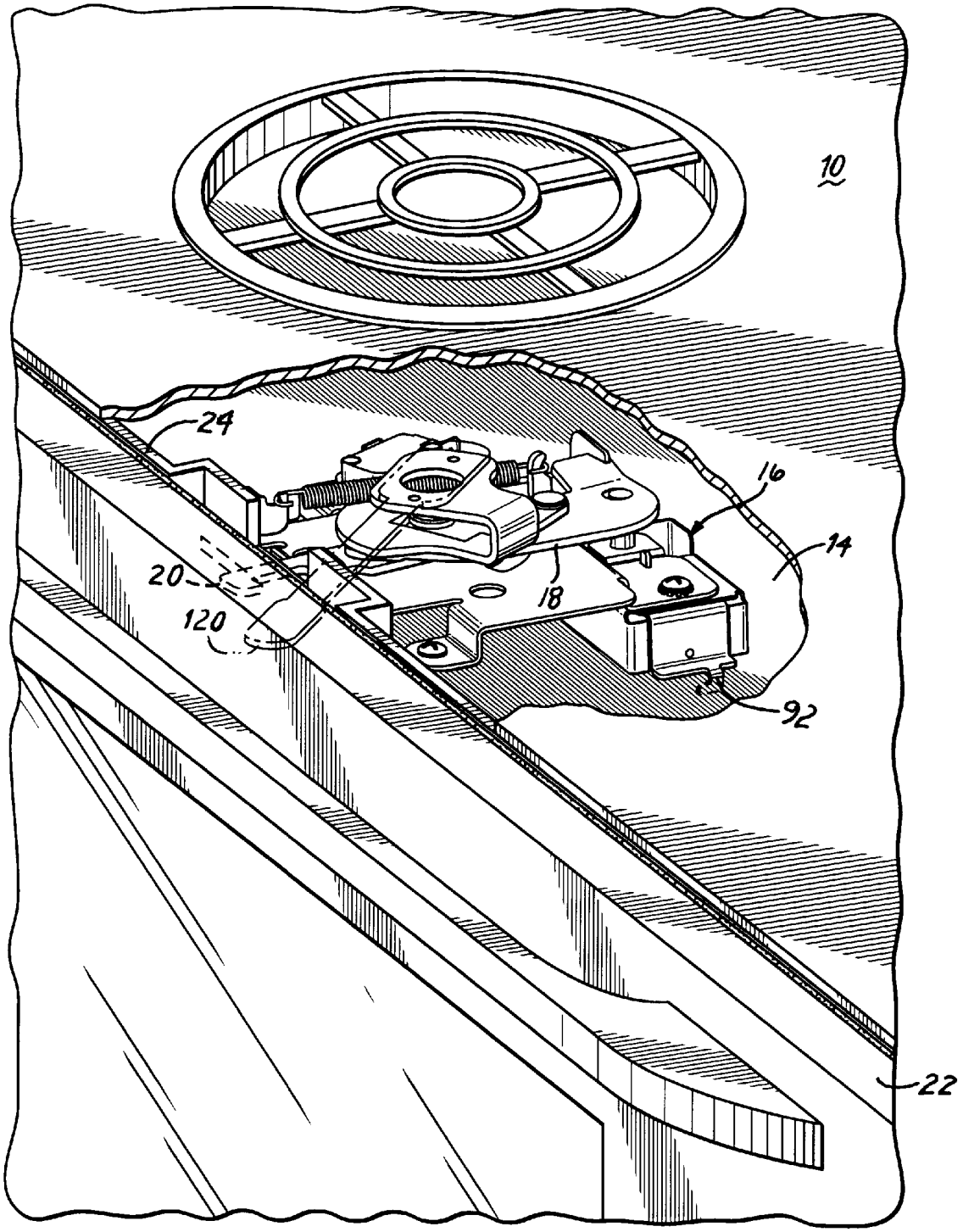
FIG. 1 is a partial cut away view of an oven having an oven door lock embodying the present invention.

Referring to FIG. 1, a cooking apparatus is generally designated by the reference numeral 10. The cooking apparatus 10 includes a cooking chamber wall 14, and a door lock 16 embodying the present invention. During a self-cleaning operation of the cooking apparatus 10, the door lock 16, which includes a latch mechanism 18 with a latch arm 20, is manually operated to latch door 22 to frame 24. The latch mechanism 18 is manually operated to release the door 22 after the self-cleaning operation is completed and the temperature of the cooking chamber 12 has fallen to a predetermined temperature.

The self-cleaning operation cannot be started without a signal verifying that the door 22 is closed and latched. If the door 22 is open when an attempt is made to initiate the self-cleaning operation, the latch mechanism 18 will be prevented from initiating the signal. Upon failing to latch the door 22 closed, the latch mechanism 18 will bias the latch arm 20 to its original unlatched state. Also, if the door 22 is closed and the cooking apparatus 10 is in use for cooking, the latch mechanism 18 will be prevented from being latched to prevent initiation of the self-cleaning operation and, thus, prevent food being cooked from being locked within the cooking apparatus 10 and, therefore, burning.

Figure 2:
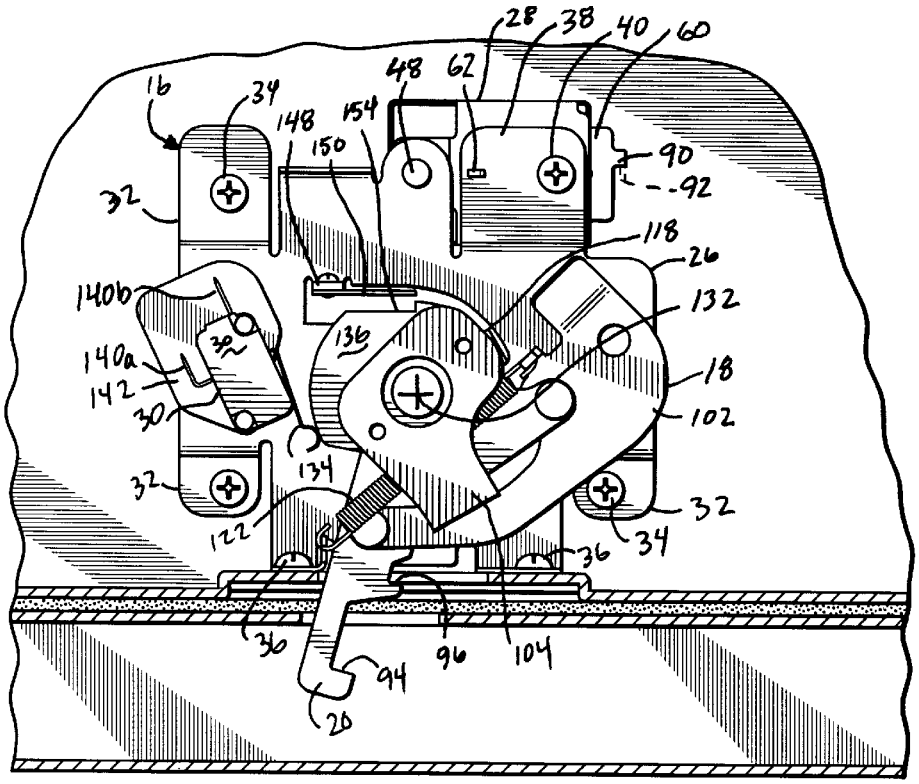
FIG. 2 is a top plan view of the oven door lock in an unlatched state.
Figure 2A:
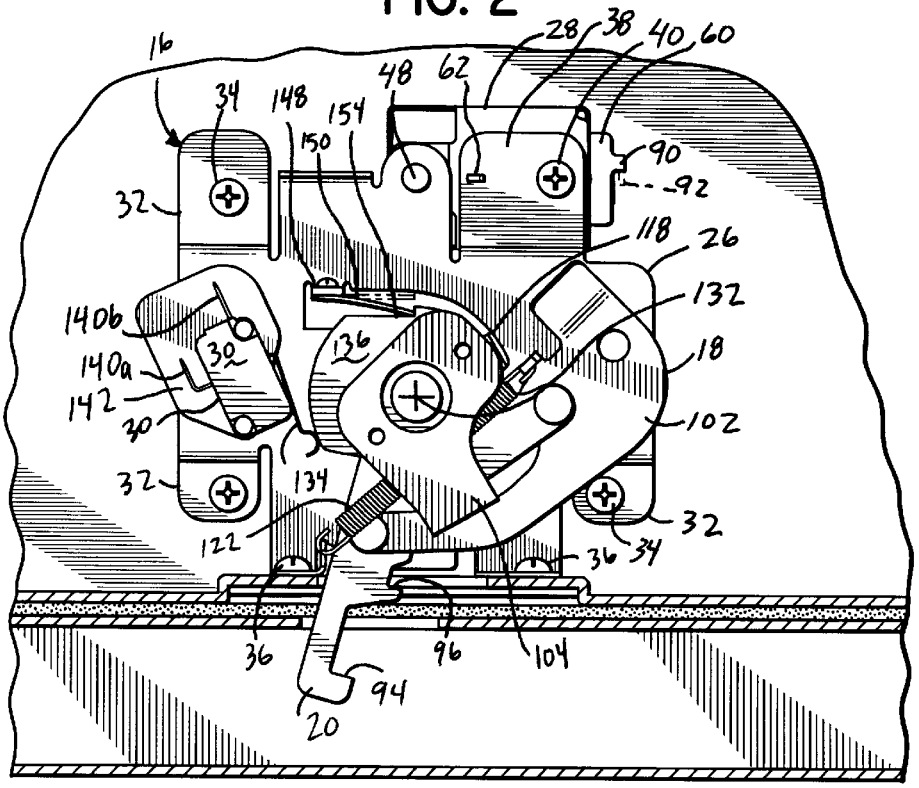
FIG. 2A is a view similar to FIG. 2.
Figure 3:
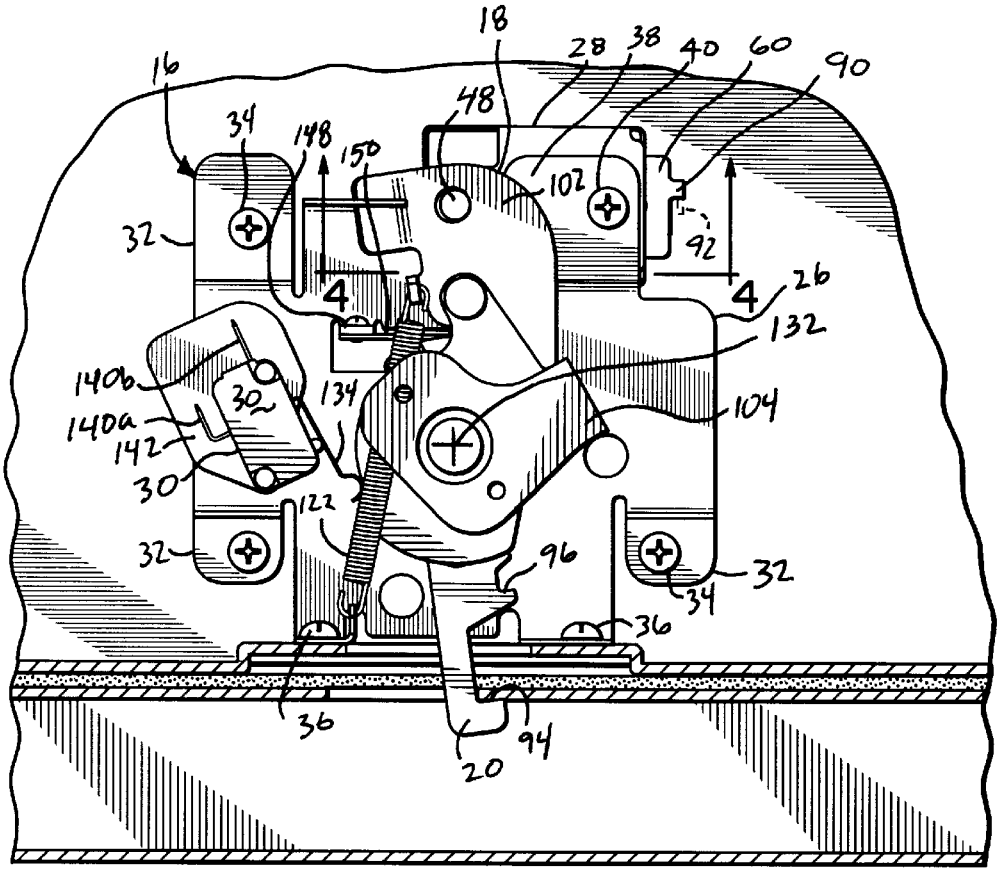
FIG. 3 is a view similar to FIG. 2 showing operation of the oven door lock.

The door lock 16 is fixed to the frame 24 in a position near the front and center of the cooking apparatus 10 and just above the cooking chamber wall 14 as illustrated in FIG. 1. As seen in FIGS. 1–3, the door lock 16 generally includes a mounting bracket 26, the latch mechanism 18, a lock mechanism 28, and a switch 30. The latch mechanism 18 is pivotally affixed to the mounting bracket 26 and biased in one of the unlatched (FIG. 2) or latched (FIG. 3) states, as discussed further below. The switch 30 indicates whether the latch mechanism 18 is in either the unlatched or latched state.

Figure 1A:
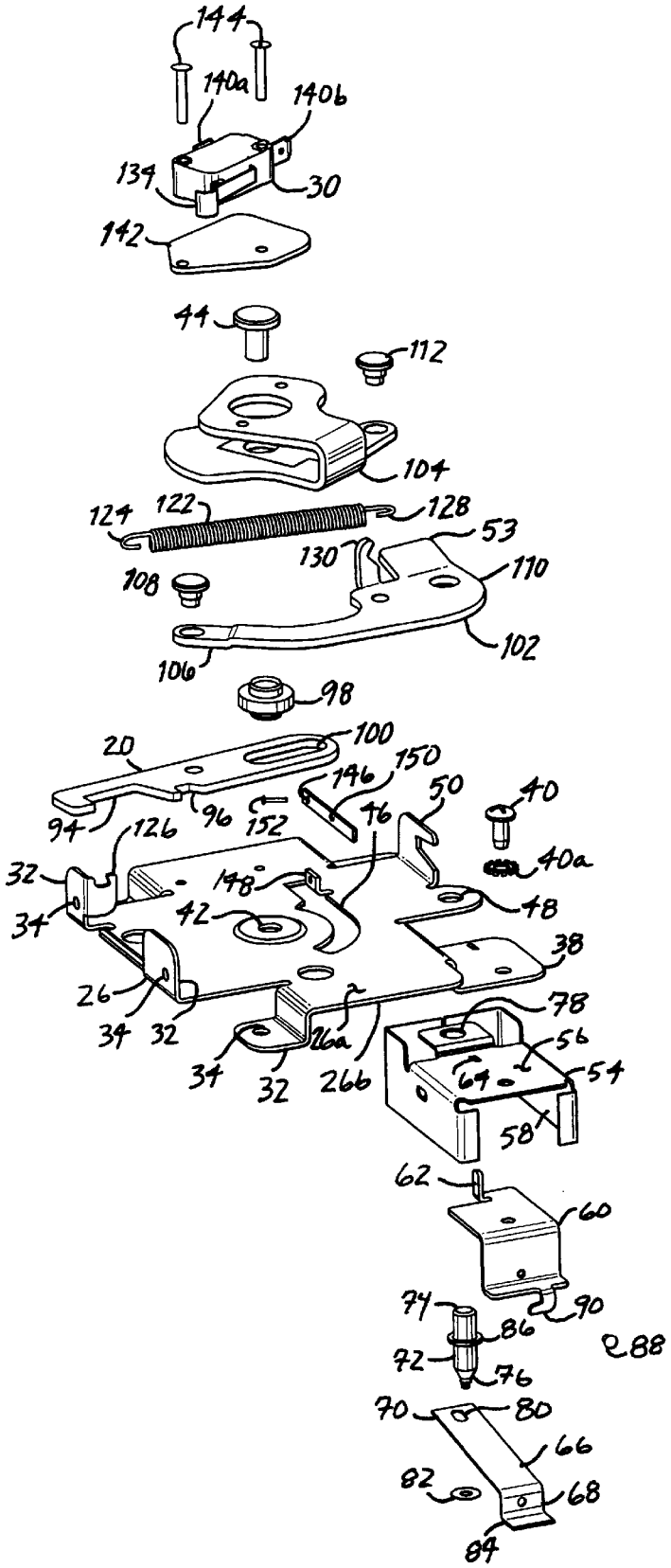
FIG. 1A is an exploded view of the oven door lock of FIG. 1.

As seen in FIG. 1A, the mounting bracket 26 has upwardly and downwardly depending mounting flanges 32 which define holes 34 through which screws 36 (FIG. 2) or any other suitable means are used to affix the mounting bracket 26 to the cooking chamber wall 14. The mounting bracket 26 also has a lock flange 38 to which the lock mechanism 28 is separably attached with screw 40 or any other suitable means. The mounting bracket 26 defines a generally centrally located pivot hole 42 through which a latch pin 44 is received which secures the latch mechanism 18 to a first surface 26*a* of the mounting bracket 26. Adjacent the pivot hole 42 is an arcuate slot 46 which limits the movement of the latch mechanism 18, as discussed further below.

Figure 4:
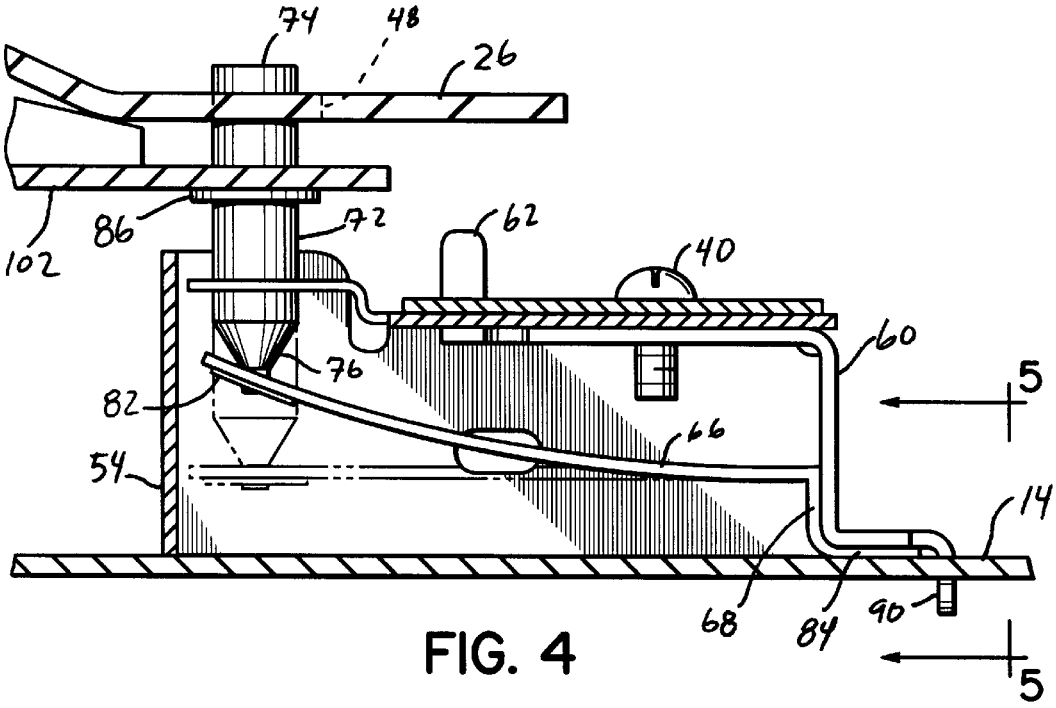
FIG. 4 is a cross-sectional view taken along line 4—4 of FIG. 3.
Figure 6:
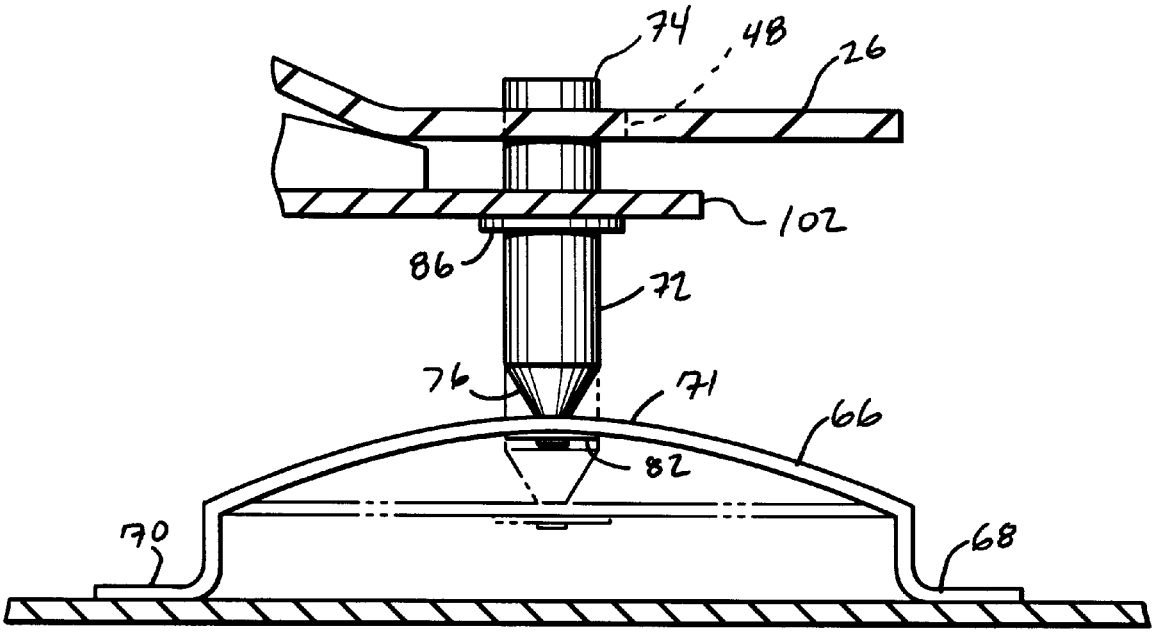
FIG. 6 is a view similar to FIG. 4 showing an alternative embodiment of a lock mechanism in accordance with the principles of the present invention.

The lock mechanism 28 has a cover 54 with an outer surface 56 received against a second surface 26*b* of the mounting bracket 26 and is separably attached to the lock flange 38 by screw 40 and lock washer 40a or any other suitable means. The cover 54 has an inside surface 58 to which a mounting foot 60 is affixed by screw 40. The mounting foot 60 has an upwardly depending finger 62 received through a slot 64 in the cover 54 to stabilize the mounting foot 60 in position against the cover 54. A first thermally responsive element, for instance, bimetallic leaf 66 is attached at a first end 68 to the mounting foot 60. In a first embodiment (FIG. 4), the bimetallic leaf 66 is attached to the mounting foot 60 as a cantilever, that is, a second end 70 of the bimetallic leaf 66 is free to deflect in response to heating the bimetallic leaf 66, as discussed further below. In a second embodiment (FIG. 6) the bimetallic leaf 66 is provided as a beam, that is, the first and second ends 68, 70 of the bimetallic leaf 66 are secured so that a center portion 71 deflects is response to heat.

A lock member, for example, lock pin 72 (see also FIG. 4), has a first end 74 received through a guide hole 48 defined in the mounting bracket 26 and a second end 76 received through a retaining hole 78 in the cover 54. The second end 76 of the lock pin 72 is received through hole 80 defined in the bimetallic leaf 66 and is affixed to the second end 70 with a retainer 82. The lock pin 72 has a radial flange 86 which limits upward deflection of the lock pin 72 through retaining hole 78.

Figure 5:
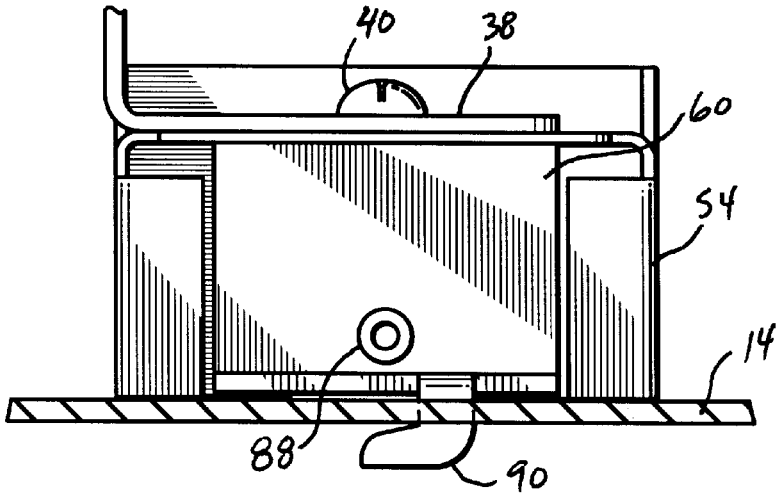
FIG. 5 is a cross-sectional view taken along line 5—5 of FIG. 4.

The first end 68 of the bimetallic leaf 66 includes a flange 84 which contacts the cooking chamber wall 14 when assembled with the cooking apparatus 10. Direct contact with the cooking chamber 14 allows the bimetallic leaf 66 to deflect more accurately in response to heating. A rivet 88 or any other suitable means affixes the bimetallic leaf 66 to the mounting foot 60. An assembly hook 90 (FIG. 5) provided on the mounting foot 60 allows the lock mechanism 28 to be assembled with the cooking chamber wall 14 with a substantial savings in time and labor by simply inserting the hook 90 into an aperture 92 (FIG. 1) in the wall 14.

The latch mechanism 18 includes the latch arm 20 having a door catch 94 which, when moved from the unlatched to the latched state, when the door 22 is closed, will engage the door 22 to maintain it in a closed position during oven self-cleaning. The latch 20 also has a safety catch 96 which, when the door 22 is not closed, will prevent the latch 20 from moving to the latched state and, thereby, prevent the cooking apparatus 10 from attempting to perform self-cleaning while the door 22 is open. The latch 20 is affixed to the mounting plate 26 with the latch pin 44 received through a bushing 98 journaled in an elongate latch slot 100.

A link arm 102 links the latch 20 to a handle mount 104 to allow manual operation of the latch mechanism 18 to move the latch 20 from the unlatched state to the latched state. The link arm 102 has a first end 106 pivotally affixed approximately medially to the latch 20 with a first link pin 108. The link arm 102 is attached proximate second end 110 to the handle mount 104 with a second link pin 112. The mounting bracket 26 has a flange 50 defining a notch 52 which accurately registers the latch mechanism 18 with the lock mechanism 28 when the latch mechanism 18 is in the latched state by receiving therein an upwardly angled flange 53 proximate the second end 110 of the link arm 102.

The handle mount 104 has an integral limit flange 118 which is received in the arcuate slot 46. The limit flange 118 travels within the arcuate slot 46 and limits movement of the latch mechanism 118 from the latched state to the unlatched state as the limit flange 118 abuts either end of the arcuate slot 46. A handle 120 is attached to the handle mount 104 by any suitable means in order to allow a user to move the latch mechanism 18 from the unlatched state to the latched state.

A spring 122 is attached at a first end 124 to a first finger 126 integral with the mounting bracket 26 and at a second end 128 to a second finger 130 integral with the link arm 102 so as to provide biasing force to maintain the latch mechanism 18 in either the latched state or the unlatched state. As seen in FIGS. 2 and 3, when the latch arm 20 is moved from the unlatched state to the latched state, the spring 122 moves over-center relative to a pivot point 132 which is generally the center of the latch pin 44. The latch mechanism 18 thus remains stable and biased in both the unlatched state and the latched state.

The switch 30 has a switch arm 134 which bears against a cam surface 136 of the handle mount 104. When the latch mechanism 18 is in the unlatched state, the cam surface 136 bears against the switch arm 134 which depresses a button 138, signaling that the door 22 is unlatched. When the latch mechanism 18 is in the latched state, the cam surface 136 allows the switch arm 134 to bias outwardly away from the button 138 which signals to a user that the door 22 is latched. The switch 30 includes electrical leads 140*a*, 140*b* which send a signal indicating when the latch mechanism 18 has successfully been positioned in the latched state. Sandwiched between the switch 30 and the mounting bracket 26 is an insulation pad 142 which provides thermal and electrical insulation between the switch 30 and the mounting bracket 26. The switch 30 and insulation pad 142 are affixed to the mounting bracket with rivets 144 or any other suitable means.

In a preferred embodiment, the door lock 16 includes a nuisance latch 146 to prevent the latch mechanism 18 from being inadvertently moved to the locked and latched state for self-cleaning operation while the cooking apparatus 10 is being used to cook food. The nuisance latch 146 includes an integral flange 148 depending upwardly from the mounting bracket 26 to which a second thermally responsive element, e.g., bimetallic leaf 150, is secured by rivet 152 or any other suitable means. When the cooking apparatus 10 is used for cooking rather than self-cleaning, bimetallic leaf 150 is heated and deflects toward the handle mount 104 and is received within a notch 154 defined in the handle mount 104. When received within the notch 154, the bimetallic leaf 150 prevents a user from moving the latch mechanism 18 from the unlatched state to the latched state.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, the thermally responsive elements need not be bimetal leaves, but could alternatively be shaped memory effect metals, wax phase transition motors, or others. The invention in its broader aspects is therefore not limited to the specific details, representative apparatus and method, and illustrative example shown and described. Accordingly, departures may be made from such details without departing from the spirit or scope of applicant's general inventive concept.

We claim:

1. An oven door locking mechanism, comprising:

a mounting bracket defining a guide hole;

a latch mechanism pivotally mounted to said mounting bracket including a link arm defining a lock hole adapted to align substantially coaxially with said guide hole; and a lock mechanism including a first thermally responsive element with a lock member affixed thereto adapted to be raised through said guide hole and said lock hole, upon actuation of said thermally responsive element.

2. The oven door locking mechanism of claim 1, wherein said mounting bracket includes a flange adapted to engage said link arm to align said lock hole and said guide hole.

3. The oven door locking mechanism of claim 2, wherein said flange defines a notch adapted to receive said link arm.

4. The oven door locking mechanism of claim 2, wherein said latch mechanism is secured to an upper surface of said mounting bracket.

5. The oven door locking mechanism of claim 4, wherein said flange depends upwardly from said upper surface.

6. The oven door locking mechanism of claim 1, wherein said thermally responsive element is received against a cavity wall to be heated.

7. The oven door locking mechanism of claim 1, wherein said thermally responsive element is a bimetallic leaf secured at a first end, said lock member affixed to a second end of said bimetallic leaf.

8. The oven door locking mechanism of claim 1, wherein said thermally responsive element is a bimetallic leaf secured at opposite ends, said lock member mounted approximately medially along said bimetallic leaf.

9. The oven door locking mechanism of claim 1, comprising a catch member adapted to assemble said mounting bracket with a wall of a cavity to be heated.

10. The oven door locking mechanism of claim 1, wherein said lock mechanism is separable from said mounting bracket.

11. The oven door locking mechanism of claim 1, comprising:

a switch affixed to said mounting bracket adapted to monitor one of a latched and an unlatched state of said latch mechanism; and thermal and electrical insulation sandwiched between said switch and said mounting bracket.

12. An oven door locking mechanism, comprising:

a mounting bracket defining a guide hole;

a latch mechanism pivotally mounted to said mounting bracket including a link arm defining a lock hole adapted to align substantially coaxially with said guide hole; and a lock mechanism including a first thermally responsive element with a lock member affixed thereto adapted to be received through said guide hole and said lock hole, in response to actuation of said thermally responsive element, and a second thermally responsive element adapted to prevent actuation of said latch mechanism.

13. The oven door locking mechanism of claim 12, wherein said second thermally responsive element is a bimetallic leaf.

14. The oven door locking mechanism of claim 12, wherein said second thermally responsive element is adapted to deflect into engagement with a notch defined in said latch mechanism.

15. An oven door locking mechanism comprising:

a mounting bracket including first and second mounting surfaces, an upwardly depending flange defining a notch, and a mounting flange, said mounting bracket defining a guide hole;

a latch mechanism pivotally mounted to said first mounting surface, said latch mechanism including a link arm having an edge and defining a lock hole adapted to align substantially coaxially with said guide hole when said edge is received within said notch;

a lock mechanism separably attached to said mounting flange, said lock mechanism including a housing with a catch adapted to engage a cavity wall to be heated, a bimetallic leaf mounted to said housing, and a lock pin affixed to said bimetallic leaf adapted to deflect in response to heating said bimetallic leaf;

a switch affixed to said mounting bracket adapted to monitor one of a latched and an unlatched state of said latch mechanism; and an insulation pad sandwiched between said switch and said mounting bracket.

16. An oven door locking mechanism, comprising:

a mounting bracket including first and second mounting surfaces, an upwardly depending flange defining a first notch, a mounting flange and plural assembly flanges, said mounting bracket defining a guide hole;

a latch mechanism pivotally mounted to said first mounting surface, said latch mechanism including a link arm having an edge adapted to engage said first notch, said link arm defining a lock hole adapted to align substantially coaxially with said guide hole when said edge is in engagement with said first notch;

a lock mechanism separably attached to said mounting flange against said second mounting surface, said lock mechanism including a housing, a catch attached to said housing adapted to be assembled to a wall of a cavity to be heated, a first bimetallic leaf mounted to said housing and having a flange adapted to be received against said wall, and a lock pin affixed to said first bimetallic leaf adapted to be deflected in response to heating said first bimetallic leaf;

a second bimetallic leaf adapted to deflect into engagement with a second notch defined in said latch mechanism to selectively prevent actuation of said latch mechanism;

a switch affixed to said mounting bracket adapted to monitor one of a latched or unlatched state of said latch mechanism; and an insulation pad sandwiched between said switch and said mounting bracket.

* * * * *